US008851932B2

(12) United States Patent
Mason et al.

(10) Patent No.: US 8,851,932 B2
(45) Date of Patent: Oct. 7, 2014

(54) CONTACTS FOR ELECTRONIC DEVICES

(71) Applicant: Tyco Electronics Corporation, Berwyn, PA (US)

(72) Inventors: Jeffery Walter Mason, North Attleboro, MA (US); Wayne Stewart Alden, III, Whitman, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 15 days.

(21) Appl. No.: 13/686,166

(22) Filed: Nov. 27, 2012

(65) Prior Publication Data

US 2014/0148061 A1 May 29, 2014

(51) Int. Cl.
*H01R 12/50* (2011.01)

(52) U.S. Cl.
CPC ..... *H01R 23/6806* (2013.01)
USPC ..... 439/660

(58) Field of Classification Search
USPC ..... 439/660, 66, 881, 889, 78
See application file for complete search history.

(56) References Cited

U.S. PATENT DOCUMENTS 5,167,512 A * 12/1992 Walkup ..... 439/66
5,192,213 A * 3/1993 Kosugi et al. ..... 439/66
5,199,889 A * 4/1993 McDevitt, Jr. ..... 439/66
5,205,739 A * 4/1993 Malo et al. ..... 439/66
5,205,742 A * 4/1993 Goff et al. ..... 439/73
5,215,472 A * 6/1993 DelPrete et al. ..... 439/71
5,221,209 A * 6/1993 D'Amico ..... 439/71
5,290,193 A * 3/1994 Goff et al. ..... 439/331
5,362,241 A * 11/1994 Matsuoka et al. ..... 439/66
5,395,254 A * 3/1995 Mogi ..... 439/70
5,469,074 A * 11/1995 Drabenstadt et al. .... 324/756.02
5,742,481 A * 4/1998 Murphy et al. ..... 361/767
6,241,560 B1 * 6/2001 Furusawa et al. ..... 439/700
6,821,131 B2 * 11/2004 Suzuki et al. ..... 439/73
7,097,485 B1 * 8/2006 Wang et al. ..... 439/289
7,794,237 B1 * 9/2010 Terhune, IV ..... 439/71
7,927,109 B1 * 4/2011 Gattuso ..... 439/66
8,147,253 B2 * 4/2012 Goodman et al. ..... 439/66
8,210,855 B1 * 7/2012 Lin ..... 439/66

* cited by examiner

*Primary Examiner* — Alexander Gilman

(57) ABSTRACT

A contact includes an upper contact having a plunger with a tip configured to engage a first electronic component being movable between a retracted position and an extended position. The upper contact has deflecting beams deflected as the plunger is forced into the retracted position and forcing the plunger to return to the extended position when the plunger is released. The contact includes a lower contact having a base beam and a tail extending from the base beam for engaging a second electronic component. The base beam engages and is spring biased against the plunger. The plunger is movable relative to the lower contact. The base beam is biased against and maintains electrical contact with the plunger as the plunger is moved between the extended and retracted positions.

20 Claims, 5 Drawing Sheets

CONTACTS FOR ELECTRONIC DEVICES

BACKGROUND OF THE INVENTION

The subject matter herein relates generally to contacts for use in electronic devices for interconnecting two electronic components.

Electronic devices, such as sockets, are used to interconnect two electronic components, such as an integrated circuit (IC) component and a printed circuit board (PCB). The sockets include an array of contacts held by an insulative socket body. Some known sockets have cantilever beam designs for the contacts. There is a desire to have the contacts on tighter pitches, which may cause a shortening in beam length. When the beam length is shortened, the amount of deflection is reduced and the beams are stiffer, making mating with the electronic components more difficult and increasing the stress on the contacts. Increasing the density of contacts within a given space results in the contacts being positioned closer together, which makes the housing walls thinner. Additionally, the cantilever design tends to have some overlap of the contacts, which increases cross-talk and degrades the signal integrity.

Some known sockets are used for circuit testing of the electronic components. The contacts of such testing sockets are used for many cycles. The contacts of such testing sockets typically use spring probes that are spring loaded and separable. An example of such contact is known as a Pogo™ pin having a cylinder containing two spring-loaded pins that interface with the two electronic components. The Pogo™ pins are machined and expensive to manufacture. Other types of spring-loaded contacts include two probes that are received in a coil spring. Such contacts require assembly time to load the ends of the probes into the spring, which is difficult and time consuming.

A need remains for a contact that is cost effective to manufacture and assemble in a socket. A need remains for a contact having high reliability.

BRIEF DESCRIPTION OF THE INVENTION

In one embodiment, an electronic device is provided including a socket body having a first surface and a second surface with a plurality of contact chambers between the first and second surfaces and a plurality of contacts received in corresponding contact chambers. The contacts include an upper contact having a plunger with a tip configured to engage a first electronic component. The upper contact has deflecting beams extending outward from the plunger that engage the socket body within the corresponding contact chamber. The deflecting beams press the upper contact in an outward direction from the contact chamber such that the tip extends beyond the first surface for mating with a first electronic component. The contacts include a lower contact having a base beam and a tail extending from the base beam. The tail extends to the second surface for mating with a second electronic component. The base beam engages the plunger and is spring biased against the plunger to electrically couple the lower contact to the upper contact. The plunger is retractable into the socket body against the force of the deflecting beams when mated to the first electronic component. The plunger moves relative to the lower contact with the base beam being biased against and maintaining electrical contact with the plunger as the plunger is retracted into the socket body.

Optionally, each contact chamber may extend along a chamber axis between the first and second surfaces. The plunger may be movable within the contact chamber between an extended position and a retracted position in a direction parallel to the chamber axis. The deflecting beams may be angled outward, non-parallel with respect to the plunger. The deflecting beams may be deflectable toward the plunger when the plunger is retracted into the socket body. The socket body may include flanges extending into the contact chambers with ramped shoulders. The deflecting beams may ride along the corresponding ramped shoulder as the upper contact is moved within the contact chamber. The upper contact may include anchors extending outward therefrom that hold the upper contact in the contact chamber.

Optionally, the plunger may extend along a longitudinal axis from the tip. The plunger may move in a direction parallel to the longitudinal axis as the plunger is retracted into the socket body. Deflection of the deflecting beams may cause the plunger to rotate about the longitudinal axis as the plunger is retracted into the socket body. The plunger may rotate relative to the base beam to cause wiping between the upper contact and the lower contact as the plunger moves within the contact chamber. The tip may rotate relative to the first electronic component to cause wiping between the tip and the first electronic component as the plunger moves within the contact chamber.

Optionally, the plunger may include a first edge and a second edge. The deflecting beams may extend from both the first edge and the second edge. The deflecting beams may include first deflecting beams and second deflecting beams. The first deflecting beams may extend from the first edge and may be folded in a first direction such that the first deflecting beam is on a first side of the plunger. The second deflecting beam may extend from the second edge and may be folded in a second direction such that the second deflecting beam is on a second side of the plunger.

Optionally, the socket body may include a base and a cover. The contacts may be captured with the contact chambers when the cover is coupled to the base. The contacts may be arranged in a matrix of rows and columns. Adjacent contacts within each row may be oriented perpendicular with respect to each other. Adjacent contacts within each column may be oriented perpendicular with respect to each other.

In another embodiment, a contact is provided including an upper contact and a lower contact. The upper contact includes a plunger with a tip configured to engage a first electronic component. The upper contact has deflecting beams extending outward from the plunger. The plunger is movable between a retracted position and an extended position. The deflecting beams are deflected as the plunger is forced into the retracted position. The deflecting beams force the plunger to return to the extended position when the plunger is released. The lower contact has a base beam and a tail extending from the base beam. The tail is configured to engage a second electronic component. The base beam engages the plunger and is spring biased against the plunger to electrically couple the lower contact to the upper contact. The plunger is movable relative to the lower contact. The base beam is biased against and maintains electrical contact with the plunger as the plunger is moved between the extended and retracted positions.

DETAILED DESCRIPTION OF SPECIFIC EMBODIMENTS OF THE INVENTION

Figure 1:
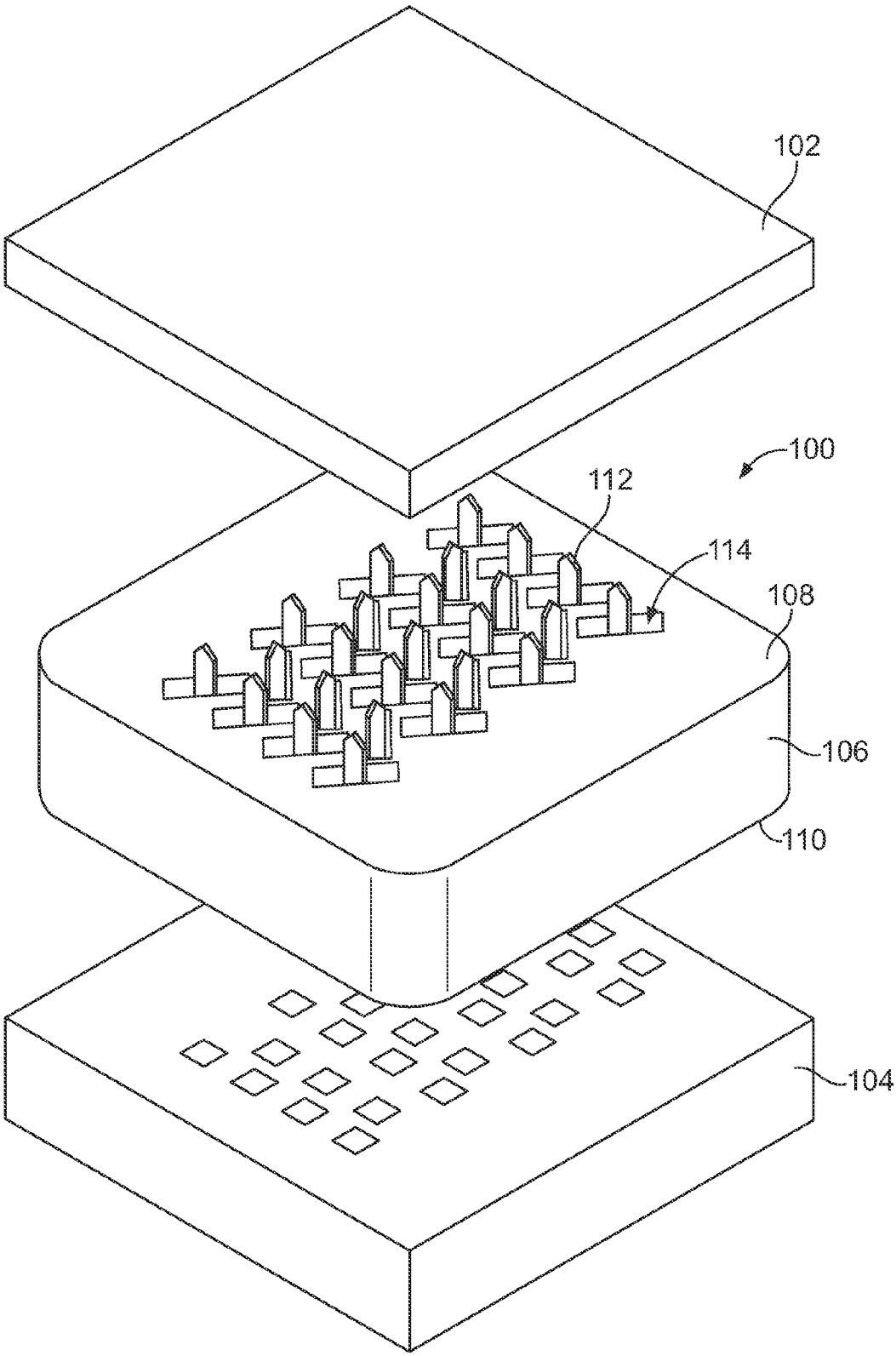
FIG. 1 illustrates an electronic device used to interconnect a first electronic component with a second electronic component.

FIG. 1 illustrates an electronic device 100 used to interconnect a first electronic component 102 with a second electronic component 104. In an exemplary embodiment, the electronic device 100 constitutes a socket, and may be referred to hereinafter as a socket 100. The electronic device 100 may be an interposer or interconnect that is positioned between the first and second electronic components 102, 104 to electrically connect circuits of such components.

In an exemplary embodiment, the electronic device 100 is mated to the first electronic component 102 at a separable mating interface. The electronic device 100 may be repeatedly mated and unmated with the first electronic component 102 or similar electronic components. In an exemplary embodiment, the electronic device 100 may define a test socket for testing an integrated circuit (IC) component or similar type of component. The IC components may be repeatedly tested and removed from the electronic device 100.

The electronic device 100 may be permanently or temporarily coupled to the second electronic component 104. For example, solder balls may be provided along the mating interface between the electronic device 100 and the second electronic component 104 to couple the electronic device 100 to the second electronic component 104. Alternatively, the electronic device 100 may be mated to the second electronic component 104 at a separable interface, such as by using spring loaded or spring biased contacts to make an electrical connection with the second electronic component 104.

The socket 100 includes a socket body 106 having a first surface 108 and a second surface 110. The socket body 106 holds a plurality of contacts 112 for interfacing with the first and second electronic components 102, 104. The contacts 112 may be held in contact chambers 114 (shown in FIG. 4) defined within the socket body 106. The socket 100 may hold any number of contacts 112. The pattern or arrangement of the contacts 112 may correspond with the corresponding contacts or pads on the first and second electronic components 102, 104 to ensure that the contacts 112 are mated to corresponding circuits of the first and second electronic components 102, 104.

In an exemplary embodiment, the contacts 112 are arranged in a matrix of rows and columns. The contacts 112 define both signal contacts and ground contacts. The signal contacts convey electrical signals between the first and second electronic components 102, 104. The ground contacts provide electrical shielding between corresponding signal contacts and may be electrically connected to a ground plane of the first electronic component 102 and/or the second electronic component 104. In an exemplary embodiment, each signal contact within a row is separated from other signal contacts within the row by a corresponding ground contact. Similarly, each signal contact within a column is separated from other signal contacts within the column by corresponding ground contacts. Other patterns of signal and ground contacts may be used in alternative embodiments. For example, a pair of signal contacts may be arranged adjacent to one another and separated from other pairs by ground contacts. In other embodiments, all of the contacts 112 may be signal contacts without any ground contacts being used.

In an exemplary embodiment, the contacts 112 are designed to have a tight pitch between adjacent contacts 112. The contacts 112 are designed to be deflectable at the first surface 108 and/or the second surface 110 for mating with the first electronic component 102 and/or the second electronic component 104. The contacts 112 may be designed to have a low compression load for mating the first and/or second electronic components 102, 104 with the socket. In an exemplary embodiment, the contacts 112 are designed to be compressible vertically such that the ends of the contacts 112 are retracted directly into the socket body 106.

Figure 2:
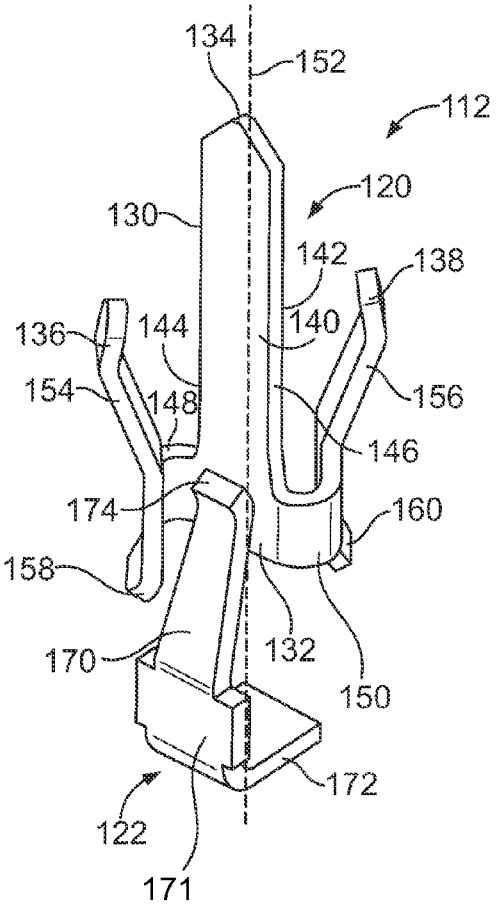
FIG. 2 is a side perspective view of an assembled contact of the electronic device according to a specific embodiment.
Figure 3:
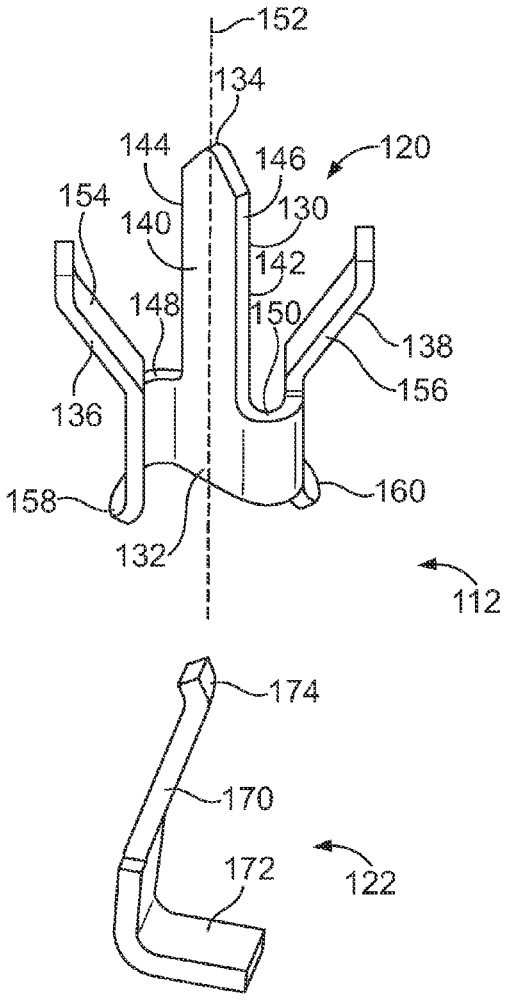
FIG. 3 is an exploded, side perspective view of the contact shown in FIG. 2.

FIG. 2 is a side perspective view of an assembled contact 112. FIG. 3 is an exploded, side perspective view of the contact 112. The contact 112 includes an upper contact 120 and a lower contact 122. The upper contact 120 is separate and discrete from the lower contact 122 to allow relative movement between the upper contact 120 and the lower contact 122. The contact 112 may be compressed by moving the upper contact 120 relative to the lower contact 122. For example, during mating with the first electronic component 102 (shown in FIG. 1), the upper contact 120 may be retracted into the socket body 106 (shown in FIG. 1) and moved downward toward the lower contact 122.

The upper contact 120 includes a plunger 130 that extends between a base 132 and a tip 134. Deflecting beams 136, 138 extend from the plunger 130. The deflecting beams 136, 138 are used to move the upper contact 120 relative to the socket body 106, as will be described in further detail below.

The upper contact 120 is manufactured from an electrically conductive material, such as a metal material. The deflecting beams 136, 138 are integral with the plunger 130. In an exemplary embodiment, the upper contact 120 includes a stamped and formed body. The plunger 130 and deflecting beams 136, 138 are stamped and formed from a planar conductive sheet. The plunger 130 includes a front side 140 and a rear side 142 that are defined by the front and rear sides, respectively of the planar metal sheet. The plunger 130 is stamped out of the planar metal sheet to form a first edge 144 and a second edge 146 opposite the first edge 144. The first and second edges 144, 146 are sheer edges formed when the plunger 130 is stamped out of the planar metal sheet.

The deflecting beams 136, 138 are bent to define spring portions 148, 150, respectively, between the deflecting beams 136, 138 and the plunger 130. The spring portions 148, 150 allow elastic movement between the plunger 130 and deflecting beams 136, 138. In an exemplary embodiment, the first deflecting beam 136 extends from the first edge 144 and is bent in a first direction such that the first deflecting beam 136 generally faces the front side 140. The second deflecting beam 138 extends from the second edge 146 and is bent in the second direction such that the second deflecting beam 138 generally faces the rear side 142. In an exemplary embodiment, the deflecting beams 136, 138 extend from the plunger 130 at the base 132.

In an exemplary embodiment, because the spring portions 148, 150 extend in different directions from the plunger 130, the spring portions 148, 150 may induce rotation of the plunger 130 about a longitudinal axis 152 as the deflecting beams 136, 138 are deflected. Such twisting or rotation about the longitudinal axis 152 causes the plunger 130 to wipe against the pads of the first electronic component 102 (shown in FIG. 1) during mating with the first electronic component 102.

The deflecting beams 136, 138 have arms 154, 156, respectively, that extend from the spring portions 148, 150. The arms 154, 156 extend generally vertically along the plunger 130. In an exemplary embodiment, the arms 154, 156 are angled outward away from the plunger 130. As the upper contact 120 is deflected to the retracted position, such as when mated with the first electronic component 102, the arms 154, 156 are deflected inward toward the plunger 130. Such deflection of the arms 154, 156 causes compression of the spring portions 148, 150 which induces twisting or rotation of the plunger 130.

In an exemplary embodiment, the deflecting beams 136 and 138 include anchors 158, 160 extending from bottoms of the deflecting beams 136, 138 and/or the spring portions 148, 150. The anchors 158, 160 are flared outward. The anchors 158, 160 are used to hold the upper contact 120 in the socket body 106, as will be described in further detail below.

The lower contact 122 includes a base beam 170 and a tail 172 extending from the base beam 170. The base beam 170 is configured to be spring biased against the upper contact 120 to ensure electrical contact between the upper contact 120 and the lower contact 122. The base beam 170 may be spring biased against the front side 140 of the plunger 130. The base beam 170 includes a tip 174 opposite the tail 172. The tip 174, which may be flared, engages the plunger 130. In some embodiments, the base beam 170 has a base portion 171 (between the tip 174 and the tail 172) that may have a width that tapers along the length of the base beam 170 toward the tip 174.

During use, as the upper contact 120 is compressed and retracted, the plunger 130 may move vertically downward toward the tail 172. The base beam 170 maintains direct physical contact with the plunger 130 as the plunger 130 is moved vertically relative to the lower contact 122. In exemplary embodiments, the tail 172 is oriented generally perpendicular with respect to the base beam 170 or the base portion 171 of base beam 170. The tail 172 defines a solder ball paddle, to which a soldered ball may be terminated.

In an alternative embodiment, the tail 172 may be a compliant tail or a deflectable tail that is configured to engage the second electronic component 104 (shown in FIG. 1). Optionally, the tail 172 may be similar to the plunger 130, wherein the lower contact 122 may be compressed into the socket body 106 during mating with the electronic components 102, 104. The lower contact 122 may include deflecting beams (not shown) similar to the deflecting beams 136, 138 of the upper contact 120.

Figure 4:
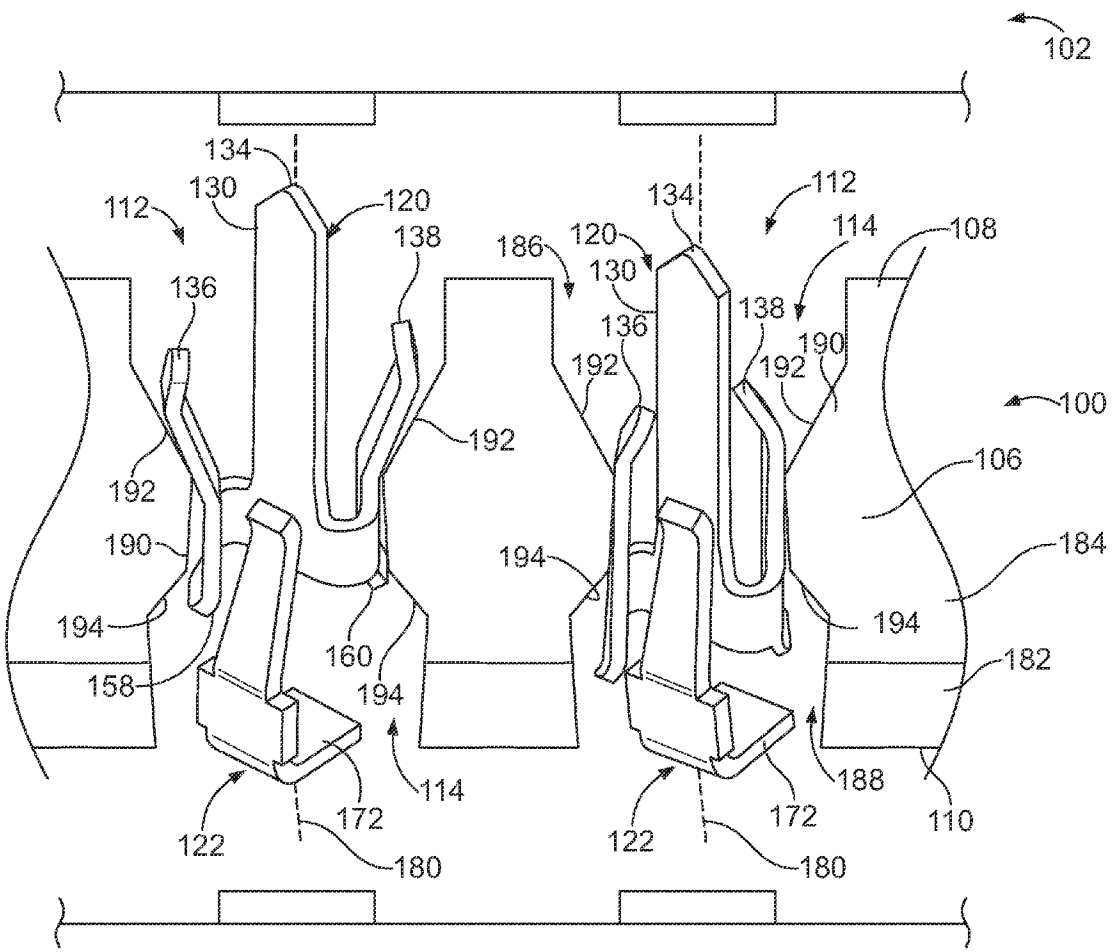
FIG. 4 is a partial sectional view of a portion of the electronic device.

FIG. 4 is a partial sectional view of a portion of the electronic device 100 showing two contacts 112 held within corresponding contact chambers 114 of the socket body 106. Portions of the socket body are removed to illustrate the contacts 112. Merely for illustration purposes, one of the contacts 112 (at the left) is illustrated in an extended position while the other contact 112 (at the right) is illustrated in a retracted position, wherein the contact 112 is at least partially compressed into the socket body 106. In an exemplary embodiment, in the extended position, the tip 134 of the plunger 130 of the upper contact 120 extends beyond the first surface 108. During mating of device 100 with the first electronic component 102, the plunger 130 is pressed into the socket body 106 to the retracted position.

In an exemplary embodiment, the contact chambers 114 formed within socket body 106 extend along respective chamber axes 180 for each contact between the first and second surfaces 108, 110 of device 100. The plunger 130 is movable within the contact chamber 114 between the extended position and the retracted position in a direction parallel to the chamber axis 180. In an exemplary embodiment, the chamber axis 180 extends vertically and the plunger 130 is compressible in a vertical direction. The plunger 130 may be retracted into the socket body 106 until the tip 134 is generally flushed with the first surface 108.

Wiping may occur at the interface between the tip 134 and the first electronic component 102 during mating. For example, the plunger 130 may be rotated about the longitudinal axis 152 (shown in FIG. 2) as the plunger 130 is compressed into the socket body 106. Such twisting or rotating of the plunger 130 causes wiping between the tip 134 and a corresponding pad of the first electronic component 102.

In an exemplary embodiment, the lower contact 122 is held in the contact chamber 114 such that the tail 172 is generally flush with the second surface 110. For example, the tail 172 may be captured below a portion of the socket body 106 (not shown). Optionally, the tail 172 may be recessed within the socket body 106 above the second surface 110. Alternatively, the tail 172 may be positioned below the second surface 110 for mating with the second electronic component 104. In an alternative embodiment, the lower contact 122 may be retractable into the socket body 106 in a similar manner as the upper contact 120.

The socket body 106 defines the contact chambers 114. The contact chambers 114 are sized and shaped to hold the contacts 112 therein. In an exemplary embodiment, horizontal movement of the contacts 112 is restricted by the walls of the contact chambers 114. The contacts 112 are, however, capable of moving in a vertical direction, such as during mating with the first electronic component 102.

In an exemplary embodiment, the socket body 106 includes a base 182 and a cover 184 coupled to the base 182. The socket body 106 includes openings 188, 186 through the base 182 and the cover 184, respectively. The contacts 112 extend through the openings 186, 188 to engage, and electrically connect to, the first and second electronic components 102, 104. The tips 134 of the plungers 130 of the upper contacts 120 extend through the openings 186 to an exterior of the socket body 106. The tails 172 of the lower contacts 122 extend through the openings 188 to an exterior of the socket body 106 to engage the corresponding pads of second electronic component 104.

During assembly, the contacts 112 are loaded into corresponding contact chambers 114 in the socket body 106. The upper contacts 120 are loaded into the cover 184 such that the tips 134 are aligned with and extend through the openings 186. The base 182 is then coupled to the cover 184 to close off the contact chambers 114. The lower contacts 122 extend through the openings 188 to engage the upper contacts 120 within the contact chambers 114. Optionally, the lower contacts 122 may be preloaded into the base 182 prior to coupling the base 182 to the cover 184. Alternatively, the base 182 may be coupled to the cover 184 prior to loading the lower contacts 122 through the openings 188. The upper contacts 120 are captured in the contact chambers 114 by the base 182 and the cover 184. The lower contacts 122 are captured in the socket body 106 by having the tails 172 captured between the base 182 and the second electronic component 104. The electronic device 100 may be assembled differently in alternative embodiments.

In an exemplary embodiment, the socket body 106 includes flanges 190 extending into the contact chambers 114 to define a necked down portion of the contact chambers 114. The flanges 190 have ramped shoulders 192 that are upward facing. The flanges 190 have lower shoulders 194 that are downward facing. The upper contacts 120 are loaded into the contact cambers 114 such that the deflecting beams 136, 138 are positioned along the ramped shoulders 192 and the anchors 158, 160 engage the lower shoulder 194. The upper contacts 120 are held in position within the contact chambers 114 by the flanges 190. For example, the anchors 158, 160 engage the lower shoulders 194 to limit upward movement of the upper contact 120.

The deflecting beams 136, 138 engage the ramped shoulders 192 to press the upper contact 120 into the extended position. When the first electronic component 102 is coupled to the electronic device 100, the spring force of the deflecting beams 136, 138 is overcome and the upper contact 120 is retracted into the socket body 106. As the upper contacts 120 are pressed downward and retracted into the socket body 106, the deflecting beams 136, 138 engage the ramped shoulders 192. The deflecting beams 136, 138 are deflected inward by the ramped shoulders 192. When the downward pressure on the plunger 130 is removed or released, such as when the first electronic component 102 is decoupled from the electronic device 100, the deflecting beams 136, 138 press outward against the ramped shoulders 192 to drive the plunger 130 upward to the extended position. The deflecting beams 136, 138 are spring biased against the ramped shoulders 192 of the flanges 190 to press the upper contact 120 upward to return the upper contact 120 to the extended position.

Figure 5:
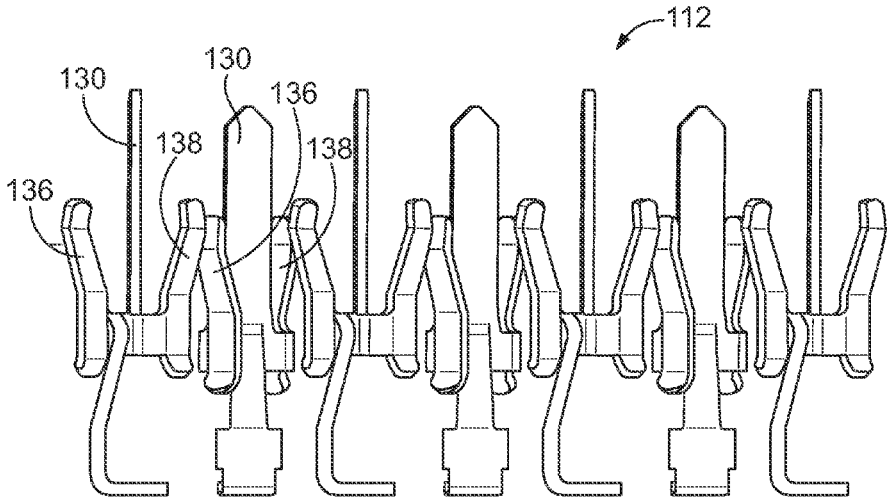
FIG. 5 is a side view of an array of the contacts.

FIG. 5 is a side view of an array of the contacts 112 with the socket body 106 (shown in FIG. 4) removed to illustrated the upper and lower contacts 120, 122. In an exemplary embodiment, contacts 112 in each row are oriented similarly but the placement of contacts 112 in each row is such that the contacts 112 in adjacent rows are offset from each other. That is, the adjacent contacts 112 (a particular contact in one row is "adjacent" to an offset contact 112 in an adjacent row) are oriented perpendicular with respect to one another when considered from a side view. For example, the plungers 130 are oriented perpendicular to each other. Such an arrangement allows tighter positioning of the contacts 112 within the socket body 106. For example, by orienting adjacent contacts 112 perpendicular to each other, the deflecting beams 136, 138 are spaced apart and do not interfere with each other. An adjacent contact may be considered to be the nearest contact. Other orientations are possible in alternative embodiments.

Figure 6:
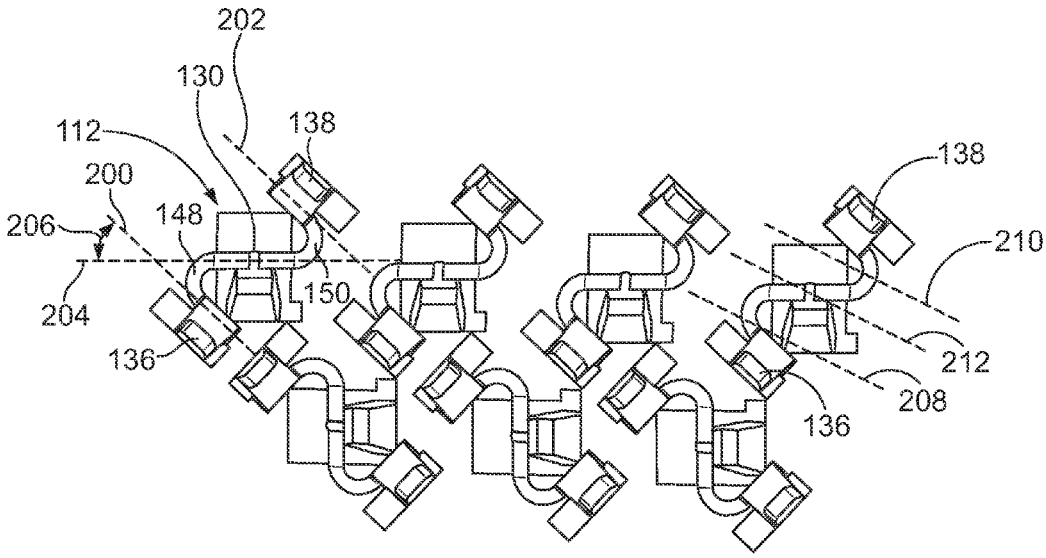
FIG. 6 is a top view of an array of the contacts.

FIG. 6 is a top view of an array of the contacts 112 with the socket body 106 (shown in FIG. 4) removed to illustrate the orientation of "adjacent" contacts 112. FIG. 6 shows the contacts 112 in adjacent rows oriented perpendicular to one another. Such orientation allows tighter positioning of the contacts 112 relative to each other.

In an exemplary embodiment, the deflecting beams 136, 138, generally extend along parallel beam axes 200, 202. The plunger 130 extends along a plunger axis 204. The plunger axis 204 is generally transverse to the beam axes 200, 202. For example the plunger axis 204 may be at an angle 206 with respect to the beam axes 200, 202. When the deflecting beams 136, 138 are deflected, such as when the upper contact 120 is retracted into the socket body 106, the spring portions 148, 150 may be compressed changing or reducing the angle 206 of the beams, such as to an orientation along beam axes 208, 210. Compression of the spring portions 148, 150 also may cause the plunger 130 to rotate to change the angle of orientation of the plunger 130 to an orientation along a plunger axis 212 different from the plunger axis 204. Optionally, the plunger axis 212 may be approximately parallel to the beam axes 208, 210 when the spring portions 148, 150 are compressed during retraction of the upper contact 120 into the body 106. Twisting of the plunger 130 causes the tip 134 to rotate and wipe along the first electronic component 102 (shown in FIG. 1) as the upper contact 120 is retracted into the socket body 106.

Figure 7:
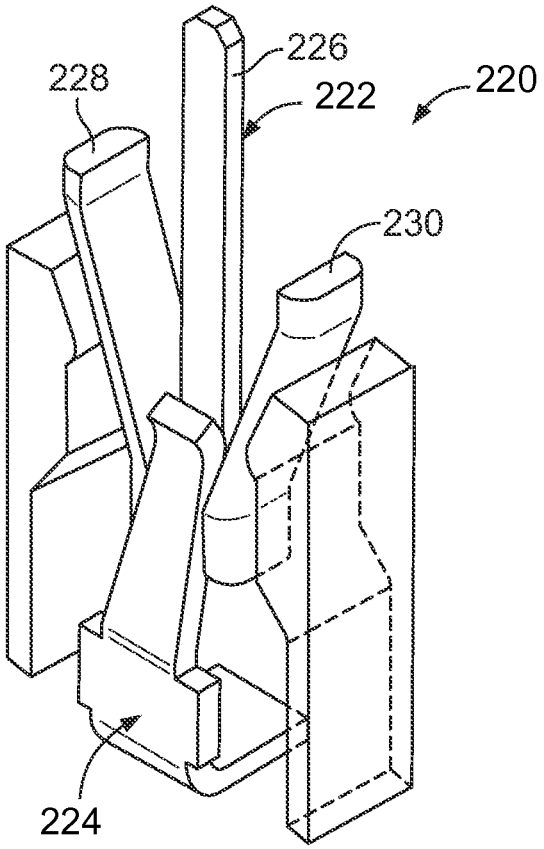
FIG. 7 is a front perspective of a contact assembly formed in accordance with an exemplary embodiment.

FIG. 7 is a front perspective of an alternative contact assembly 220 showing only portions of a socket body. The contact assembly 220 includes an upper contact 222 and a lower contact 224. The lower contact 224 may be substantially similar to the lower contact 122 (shown in FIG. 2). The upper contact 222 includes a plunger 226 and deflecting beams 228, 230 extending from the plunger 226. In the illustrated embodiment, the deflecting beams 228, 230 may be plastic compression beams. The deflecting beams 228, 230 are separate from the plunger 226 and coupled to the plunger 226. Optionally, the deflecting beams 228, 230 may be inserted molded around the plunger 226. Having plastic deflecting beams 228, 230 may provide greater isolation between adjacent contacts 112, thus reducing cross talk or other electromagnetic interference between adjacent contact assemblies 220. In other embodiments, the deflecting beams 228, 230 may be made of other materials, including compliant spring metal, that are attached to the plunger 226.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electronic device comprising:

a socket body having a first surface and a second surface, the socket body having a plurality of contact chambers between the first and second surfaces; and a plurality of contacts each received in a corresponding contact chamber, each of the plurality of contacts comprising:

an upper contact having a plunger with a tip configured to engage a first electronic component, the upper contact having deflecting beams extending outward from the plunger, the deflecting beams engaging the socket body within the corresponding contact chamber, the deflecting beams pressing the upper contact in an outward direction from the contact chamber such that the tip extends beyond the first surface for mating with the first electronic component; and a lower contact having a base beam and a tail extending from the base beam, the tail extending to the second surface for mating with a second electronic component, the base beam engaging the plunger and being spring biased against the plunger to electrically couple the lower contact to the upper contact;

wherein the plunger is retractable into the socket body against the force of the deflecting beams when mated to the first electronic component, the plunger moving relative to the lower contact with the base beam being biased against and maintaining electrical contact with the plunger as the plunger is retracted into the socket body.

2. The electronic device of claim 1, wherein each contact chamber extends along a chamber axis between the first and second surfaces, the plunger being movable within the contact chamber between an extended position and a retracted position in a direction parallel to the chamber axis.

3. The electronic device of claim 1, wherein the upper contact has a base, the plunger extending upward from the base to the tip, the deflecting beams extend from the base and are angled outward, non-parallel with respect to the plunger with the plunger being positioned between the deflecting beams, the deflecting beams being deflectable toward the plunger when the plunger is retracted into the socket body.

4. The electronic device of claim 1, wherein the socket body includes flanges extending into the contact chambers, the flanges have ramped shoulders, the deflecting beams riding along the corresponding ramped shoulder as the upper contact is moved within the contact chamber.

5. The electronic device of claim 1, wherein the upper contact includes anchors extending outward therefrom, the anchors holding the upper contact in the contact chamber.

6. The electronic device of claim 1, wherein the plunger extends along a longitudinal axis from the tip, the plunger moving in a direction parallel to the longitudinal axis as the plunger is retracted into the socket body, deflection of the deflecting beams causing the plunger to rotate about the longitudinal axis as the plunger is retracted into the socket body.

7. The electronic device of claim 6, wherein the plunger rotates relative to the base beam to cause wiping between the upper contact and the lower contact as the plunger moves within the contact chamber.

8. The electronic device of claim 6, wherein the tip rotates relative to the first electronic component to cause wiping between the tip and the first electronic component as the plunger moves within the contact chamber.

9. The electronic device of claim 1, wherein the plunger includes a first edge and a second edge, the deflecting beams extending from both the first edge and the second edge.

10. The electronic device of claim 9, wherein the deflecting beams of one of the plurality of the contacts include a first deflecting beam and a second deflecting beam, the first deflecting beam extending from the first edge and being folded in a first direction such that the first deflecting beam is on a first side of the plunger, the second deflecting beam extending from the second edge and being folded in a second direction such that the second deflecting beam is on a second side of the plunger.

11. The electronic device of claim 1, wherein the socket body includes a base and a cover, the contacts being captured with the contact chambers when the cover is coupled to the base.

12. The electronic device of claim 1, wherein the contacts are arranged in a matrix of rows and columns, adjacent contacts being oriented perpendicular with respect to each other.

13. A contact comprising:

an upper contact having a base and a plunger extending upward from the base to a tip, the plunger configured to engage a first electronic component, the upper contact having deflecting beams extending upward and outward from the base with the plunger being positioned between the deflecting beams, the plunger being movable between a retracted position and an extended position, the deflecting beams being deflected as the plunger is forced into the retracted position, the deflecting beams forcing the plunger to return to the extended position when the plunger is released; and a lower contact having a base beam and a tail extending from the base beam, the tail being configured to engage a second electronic component, the base beam engaging the plunger and being spring biased against the plunger to electrically couple the lower contact to the upper contact, wherein the plunger is movable relative to the lower contact, the base beam being biased against and maintaining electrical contact with the plunger as the plunger is moved between the extended and retracted positions.

14. The contact of claim 13, wherein the plunger is movable in a vertical direction.

15. The contact of claim 13, wherein the deflecting beams are angled outward, non-parallel with respect to the plunger, the deflecting beams being deflectable toward the plunger when the plunger is moved to the retracted position.

16. The contact of claim 13, wherein the deflecting beams are spring biased outward to force the upper contact to move in an upward direction to the extended position.

17. The contact of claim 13, wherein the plunger extends along a longitudinal axis from the tip, the plunger moving in a direction parallel to the longitudinal axis as the plunger is moved to the retracted position, deflection of the deflecting beams causing the plunger to rotate about the longitudinal axis as the plunger is moved to the retracted position.

18. The contact of claim 17, wherein the plunger rotates relative to the base beam to cause wiping between the upper contact and the lower contact as the plunger moves to the retracted position.

19. The contact of claim 17, wherein the tip rotates relative to the first electronic component to cause wiping between the tip and the first electronic component as the plunger moves to the retracted position.

20. The contact of claim 13, wherein the plunger includes a first edge and a second edge, the deflecting beams including a first deflecting beam and a second deflecting beam, the first deflecting beam extending from the first edge and being folded in a first direction such that the first deflecting beam is on a first side of the plunger, the second deflecting beam extending from the second edge and being folded in a second direction such that the second deflecting beam is on a second side of the plunger.

* * * * *